US011179739B2

(12) United States Patent
Baumann

(10) Patent No.: US 11,179,739 B2
(45) Date of Patent: Nov. 23, 2021

(54) LIQUID DISPENSER

(71) Applicant: Aptar Radolfzell GmbH, Radolfzell (DE)

(72) Inventor: Tobias Baumann, Constance (DE)

(73) Assignee: APTAR RADOLFZELL GMBH, Radolfzell (DE)

( * ) Notice: Subject to any disclaimer, the term of this patent is extended or adjusted under 35 U.S.C. 154(b) by 12 days.

(21) Appl. No.: 16/625,411

(22) PCT Filed: Jun. 21, 2018

(86) PCT No.: PCT/EP2018/066686
§ 371 (c)(1),
(2) Date: Dec. 20, 2019

(87) PCT Pub. No.: WO2019/011622
PCT Pub. Date: Jan. 17, 2019

(65) Prior Publication Data

US 2021/0121904 A1 Apr. 29, 2021

(30) Foreign Application Priority Data

Jul. 13, 2017 (EP) ..... 17181288

(51) Int. Cl.
*B05B 11/00* (2006.01)
*A45D 34/00* (2006.01)

(52) U.S. Cl.
CPC ..... *B05B 11/3033* (2013.01); *A45D 34/00* (2013.01); *B05B 11/0044* (2018.08);
(Continued)

(58) Field of Classification Search
CPC ..... B05B 11/3033; B05B 11/0044; B05B 11/3035; B05B 11/3069; A45D 2200/057; A45D 34/00
See application file for complete search history.

(56) References Cited

U.S. PATENT DOCUMENTS 4,201,317 A 5/1980 Aleff
4,979,646 A * 12/1990 Andris ..... B05B 11/3033 222/136

(Continued)

FOREIGN PATENT DOCUMENTS

CN 102099122 A 6/2011
CN 103608123 A 2/2014

(Continued)

OTHER PUBLICATIONS

International Search Report issued in International Application No. PCT/EP2018/066686, with English translation, dated Aug. 24, 2018 (6 pages).

(Continued)

*Primary Examiner* — Jeremy Carroll
(74) *Attorney, Agent, or Firm* — Flynn Thiel, P.C.

(57) ABSTRACT

A discharge head for a liquid dispenser having a base, an actuation handle, a liquid inlet and a discharge opening. The discharge head has a pump mechanism which conveys liquid from a liquid store to the discharge opening. To control liquid to be discharged and/or inflowing air, the discharge head has a valve with a valve flap which closes a valve channel and transfers to an open position by a positive pressure that exceeds a threshold positive pressure. The discharge head has an effector element bearing on the handle and the base, which deforms when the handle is pressed down. The valve flap is designed and attached to the effector element such that the deformation of same acts on the valve flap so that the threshold positive pressure, beyond which the valve flap leaves its closed position, is at least 10% lower in an actuated end position than in a non-actuated end position.

20 Claims, 3 Drawing Sheets

(52) U.S. Cl.
CPC ..... *B05B 11/3035* (2013.01); *B05B 11/3069* (2013.01); *A45D 2200/057* (2013.01)

(56) References Cited

U.S. PATENT DOCUMENTS

| | | | | |
|---|---|---|---|---|
| 5,014,881 | A * | 5/1991 | Andris | B05B 11/3033 222/207 |
| 5,238,156 | A | 8/1993 | Andris | |
| 5,544,789 | A * | 8/1996 | Gillingham | B05B 11/3033 222/153.13 |
| 5,992,704 | A * | 11/1999 | Jager-Waldau | B05B 11/0005 222/341 |
| 6,406,207 | B1 | 6/2002 | Wiegner et al. | |
| 6,755,327 | B1 | 6/2004 | Hazard et al. | |
| 7,677,415 | B2 * | 3/2010 | Auer | B05B 11/0032 222/207 |
| 7,793,803 | B2 | 9/2010 | Neerincx et al. | |
| 8,292,129 | B2 | 10/2012 | Stadelhofer et al. | |
| 9,079,206 | B2 | 7/2015 | Doulin et al. | |
| 10,022,740 | B2 | 7/2018 | Van Swieten et al. | |
| 10,035,159 | B2 | 7/2018 | Bruder et al. | |
| 2010/0116849 | A1 * | 5/2010 | Lautre | B05B 11/3033 222/153.13 |
| 2012/0024904 | A1 * | 2/2012 | Doulin | B05B 11/3035 222/207 |
| 2012/0145747 | A1 * | 6/2012 | Knopow | B67D 7/005 222/375 |
| 2014/0239017 | A1 | 8/2014 | Van Schuckmann | |
| 2016/0138953 | A1 | 5/2016 | Greiner-Perth et al. | |
| 2016/0332180 | A1 * | 11/2016 | Bruder | B05B 11/3053 |

FOREIGN PATENT DOCUMENTS

| | | | |
|---|---|---|---|
| CN | 105593136 | A | 5/2016 |
| DE | 4041136 | A1 | 7/1992 |
| DE | 19729516 | A1 | 1/1999 |
| DE | 60304349 | T2 | 10/2006 |
| DE | 102014200867 | A1 | 8/2015 |
| EP | 2210674 | A2 | 7/2010 |
| EP | 2763796 | B1 | 11/2015 |
| WO | 2006031110 | A1 | 3/2006 |
| WO | 2010106256 | A1 | 9/2010 |

OTHER PUBLICATIONS

Written Opinion of International Searching Authority issued in International Application No. PCT/EP2018/066686, dated Aug. 24, 2018 (7 pages).

Office Action of European Patent Office issued in corresponding European Application No. 17181288.6, dated Jan. 10, 2018 (10 pages).

Office Action from the Intellectual Property Office of India issued in corresponding Indian Application No. 201917053176 dated May 28, 2020 (6 pages).

Chinese Office Action with partial English Translation issued in corresponding Chinese Application No. 201880046766.X dated Dec. 18, 2020 (13 pages).

* cited by examiner

LIQUID DISPENSER

FIELD OF APPLICATION AND PRIOR ART

The invention relates to a discharge head for a liquid dispenser for discharging pharmaceutical or cosmetic liquids, and to a liquid dispenser, equipped with the discharge head.

A discharge head of the type in question has a base and an actuation handle which can be pressed down relative to the latter and by means of which a pump mechanism can be actuated. Such a discharge head usually has a series of valves, in particular at least one of the valves described below. An outlet valve opens depending on pressure, and is arranged between the pump chamber and the discharge opening, and serves to open, as the size of the pump chamber decreases in the course of the actuation, through the liquid pressure of the liquid in the pump chamber, such that the liquid can be dispensed through a discharge opening, but closes during the return stroke. An inlet valve opens depending on pressure, and is arranged between the liquid inlet and the pump chamber, and opens in the course of the return stroke after an actuation, under the effect of the negative pressure in the pump chamber, in order to suck liquid into the pump chamber for the next discharging procedure. The inlet valve is closed during the discharge of liquid. A ventilation valve opens depending on pressure and serves to open a ventilation channel when, after a discharge, a negative pressure has been established in the liquid store. In the idle state of the discharge head, the ventilation valve is to close, so that no contamination can enter.

All of these valves are intended to be closed in certain phases of the operation and to be opened in other phases. The opening process is controlled mainly by the prevailing liquid pressure and/or gas pressure. If a certain threshold positive pressure defined by the configuration of the valve is exceeded, this leads to a deflection of a valve body, in particular of a valve flap, such that liquid or air can flow through, until the pressure again drops below the threshold positive pressure and the respective valve closes again.

A problem of known embodiments is that there is often a conflict of aims in the design of the valve. For example, it is desirable that the threshold positive pressure for opening the outlet valve is as low as possible, such that even a gentle actuation of the actuation handle causes a continuous stream of liquid. At the same time, however, it is also desirable that, in an idle state of the discharge head, a high threshold positive pressure is needed to bring about opening, such that the outlet valve does not accidentally open in a situation where there is a low ambient pressure, for example in the hold of an airplane or in a filling installation operating in a negative pressure atmosphere. Similarly, as regards the ventilation valve, provision is made that the latter very safely closes the liquid store in the absence of a negative pressure in the liquid store, but reliably opens during or after the actuation, such that no negative pressure remains in the liquid store. In the case of the inlet valve, in the same way as with the outlet valve, it is important that it safely closes in the idle state of the discharge head, such that a negative pressure situation in the environment cannot cause opening. However, if there is a negative pressure in the pump chamber, the inlet valve should as far as possible open immediately.

The prior art discloses, for example in EP2210674 A2, dispensers in which, for the purpose of what is called priming, i.e. the initial filling of the pump chamber with liquid, a forced opening of the inlet valve takes place at the end of the stroke, so that the air located therein in the delivery state is forced back into the liquid store. A pin provided in a fixed position in relation to the actuation handle serves as a kind of carrier which, toward the end of the actuation stroke, runs onto a dome-shaped valve and, upon continued movement, deforms the latter and thus opens it.

EP 2763796 B1, WO 2006/031110 A1 and WO 2010/106256 A1 disclose various dispensers in which the pump chamber is formed by a hose-like, elastically deformable pump chamber body which has, also in an integral manner, an inlet valve flap or an outlet valve flap. These dispensers are in each case designed in such a way that the valve flaps are decoupled from the deformation of the rest of the body. The application of force to the valve flaps for the purpose of opening is thus effected only by the gas or liquid pressures present on both sides of the valve flaps. Therefore, the respective threshold positive pressure needed to open the respective valves does not depend on the degree of deformation of the respective pump chamber bodies.

Problem and Solution

The problem addressed by the invention is to develop a discharge head of the type in question in such a way that it advantageously lessens the stated conflict of aims pertaining to the respective threshold positive pressures at the valve flaps.

To this end, a discharge head is proposed which, in line with discharge heads of the type in question, has a base and an actuation handle which can be pressed down relative to the base in an actuation direction between a non-actuated end position and an actuated end position. Moreover, the discharge head has a liquid inlet for connection to a liquid store and a discharge opening for dispensing liquid to an environment, and it has a pump mechanism with a pump chamber, which is arranged between the actuation handle and the base and by means of which liquid can be conveyed from the liquid store to the discharge opening.

A discharge head of the type in question has at least one of the three following valves. An outlet valve which opens depending on pressure, and which is arranged between the pump chamber and the discharge opening, opens, as the pump chamber decreases in size, through the liquid pressure of the liquid in the pump chamber. An inlet valve which opens depending on pressure, and which is arranged between the liquid inlet and the pump chamber, opens, as the pump chamber increases in size, through the negative pressure in the pump chamber. A ventilation valve, which opens depending on pressure, opens when there is a negative pressure in the liquid store.

According to the invention, provision is made that at least one of these valves has a variable threshold positive pressure beyond which it opens, wherein this variable threshold positive pressure depends on the relative position of the actuation handle with respect to the base. This is to be understood as meaning that the force with which the respective valve is kept closed for structural reasons, with the same pressure on both sides of the valve, is different in the respective end positions, i.e. lower in the actuated end position of the actuation handle compared to the non-actuated end position of the actuation handle.

In the case of the outlet valve, this is the threshold positive pressure that is needed in the pump chamber in order to open the valve, in relation to a surrounding atmosphere into which the discharge is intended to take place. In the case of the inlet valve, it is the threshold positive pressure in the surrounding atmosphere in relation to the liquid store. In the case of the inlet valve, it is the threshold positive pressure in the liquid store in relation to the pump chamber.

To achieve the variable threshold positive pressure, the discharge head has an effector element which bears on the actuation handle and on the base and is preferably secured there, such that it deforms when the actuation handle is pressed down. This deformation of the effector element, made from an elastic material such as an elastomer, acts on a valve flap of the outlet valve, of the inlet valve and/or of the ventilation valve, which flap is attached to the effector element, wherein this effect lies in an application of a force or moment, by which the force with which the respective valve is kept closed for structural reasons, with the same pressure on both sides of the valve, drops and the required threshold positive pressure thus also falls. To ensure that the desired positive effects associated with this are sufficiently apparent, the design of the effector element and/or of the respective valve flap and the attachment of the valve flap to the effector element are such that a reduction of the threshold positive pressure of at least 10% is achieved.

The effect that can thereby be achieved is different for the different valve types.

In the case of the outlet valve, the fact that the threshold positive pressure for opening the valve falls during actuation means that there is less risk of an oscillating opening and closing of the outlet valve in the event of slow actuation, which makes dosed discharge difficult. Moreover, the threshold positive pressure in the non-actuated end position can be chosen higher, such that there is less risk of the dispenser leaking in a surrounding atmosphere of low ambient pressure, for example in the hold of an airplane.

In the case of the inlet valve, which deliberately opens during the return stroke, the aspiration of liquid at the start of the return stroke takes place more quickly and the actuation handle returns more quickly to its non-actuated end position and can accordingly be reused more quickly. Moreover, it is likewise true of the inlet valve that the threshold positive pressure in the non-actuated end position can be chosen higher, such that there is less chance of a surrounding negative pressure drawing liquid through the inlet valve and outlet valve out of the dispenser.

In the case of the ventilation valve, the effect achieved is that the latter reliably opens more or less simultaneously with the opening of the inlet valve, so as to directly ensure a pressure equalization in the liquid store. By contrast, in the non-actuated end position, the ventilation valve is reliably closed, such that contaminants are prevented from entering the liquid store when the dispenser is not used for a long period of time.

As regards to all three valve types, the mode of operation is in principle identical. A compressible effector element is placed or secured with opposite ends at the base and at the actuation handle, such that it is deformed by compression during an actuation. The respective valve flap is attached to the effector element, preferably by being formed integrally thereon, such that this deformation of the effector element also causes a force or moment to be coupled into the valve flap, wherein this force or this moment is oriented in the direction into which the valve flap is shifted for the purpose of opening the respective valve. The force with which the valve flap is pressed against its associated mating surface thus falls, and the threshold positive pressure needed to open the valve falls.

In order to provide measurable advantages, said fall of the threshold positive pressure is sought to be by at least 10%. However, it is advantageous if the threshold positive pressure falls even further, in particular by at least 30% or even by at least 40%.

The threshold positive pressure of the outlet valve can, for example, be over 800 mbar in the non-actuated end position and less than 700 mbar in the actuated end position. In the case of the inlet valve, the threshold positive pressure can be, for example, over 100 mbar in the non-actuated end position and less than 90 mbar in the actuated end position. In the case of the ventilation valve, the threshold positive pressure can be, for example, over 200 mbar in the non-actuated end position and less than 180 mbar in the actuated end position.

Since the effector element is secured to the base and to the actuation handle, its deformation begins more or less directly with the start of the movement of the actuation handle. Since this deformation leads to the fall of the threshold positive pressure, the latter preferably also falls directly at the start of the actuation. It is considered advantageous if the threshold positive pressure has already fallen by at least 5%, particularly preferably by at least 15% or even by at least 20%, by the actuation handle having been moved to a middle position between the non-actuated end position and the actuated end position.

Particularly in the case of the outlet valve and of the inlet valve, it is advantageous if there is a relevant fall of the threshold positive pressure over most of the path between the end positions, since this permits the uninterrupted opening of the outlet valve and, on account of the easy opening of the inlet valve, the rapid return of the actuation handle to the non-actuated end position. In the case of the ventilation valve, the facilitated opening over a large part of the path between the end positions is advantageous, since the pressure equalization is required in the phase in which the aspiration of liquid from the liquid store into the pump chamber takes place. The ventilation valve should therefore be reliably opened over most of the return stroke and should reliably close only toward the end.

The threshold positive pressure at the valves of different valve types preferably falls by less than 100% as a result of the force applied to the respective valve flap during the transfer from the non-actuated end position to the actuated end position. Therefore, even in the actuated end position, a positive pressure is preferably necessary to open the respective valve. This is advantageous in the case of the outlet valve, since otherwise the aspiration taking place during the return stroke under the effect of a negative pressure in the pump chamber would be disturbed and there would be a danger of air flowing through the discharge opening into the pump chamber during the return stroke. In the case of the inlet valve and of the ventilation valve, it is also considered desirable that they are not opened in the actuated end position solely on account of the deformation of the effector element. Here, however, such opening of the respective valve at the end position is less harmful, and it may in some cases even be advantageous in order to suction liquid into the pump chamber or air into the liquid store.

The effector element is by definition placed on the base and on the actuation handle and in particular secured thereto, which is to be understood as meaning that it is necessarily deformed as the actuation handle moves closer to the base. The effector element is preferably secured to the base and to the actuation handle by a clamping connection or the like.

If several valves are present which, in accordance with the invention, have a valve flap attached to the effector element, provision can be made for the valve flaps to be attached to a common effector element and also for them to be attached to different effector elements. The effector element for acting on a valve flap can serve as a dedicated effector element, solely for acting on one or more valve flaps, and can be separate from the rest of the pump mechanism.

However, an embodiment is advantageous in which the pump mechanism itself has an elastically compressible component which at the same time also forms the effector element. In particular, the pump mechanism can have a pump chamber wall which surrounds the pump chamber and which is formed by a deformable hose-like pump chamber component which is secured with an open inlet side to the base and is secured with an open outlet side to the actuation handle. In such an embodiment, the effector element is preferably integrally connected to the pump chamber component, wherein in particular the effector element is preferably formed by the pump chamber wall or a part thereof.

The effect of the deformation of the effector element on the valve flap can be realized in different ways. An embodiment is advantageous in which the effector element has a shape which is curved or bent several times in opposite directions and which shortens in the manner of a concertina upon actuation of the actuation handle. In the case where the effector element is formed by the pump chamber wall, this effect can be realized by the pump chamber wall being configured at least in part in the form of a bellows with a shape that is curved or bent several times in opposite directions.

Such a configuration is advantageous for the intended influencing of the threshold positive pressure of a valve, since in this way it is possible to ensure a deformation of the effector element that is easily reproducible. Moreover, the subportions intended to swivel in opposite directions in the concertina shape or zigzag shape are well suited for direct or indirect coupling of moments into the valve flaps. This embodiment is thus particularly suitable for pivotable valve flaps.

In a preferred embodiment, a subportion of the effector element, in particular a first or last subportion of such a concertina-like effector element, can already be oriented at an angle to the actuation direction in the non-actuated end position of the actuation handle. The subportion is in this case arranged at the effector element in such a way that it is swiveled to a more strongly angled orientation to the actuation direction by a kind of pivoting movement upon actuation of the actuation handle. The valve flap can be arranged on this subportion, or on an adjacent subportion swiveling therewith to a slightly lesser extent, such that a moment acting in the opening position acts on the valve flap when the actuation handle is pressed down.

Preferably at at least one end, the effector element has a securing portion, in particular a circumferential securing portion, which is secured to the actuation handle or to the base, in particular by being clamped in or clamped on. An easily deformable tilting web, in particular a circumferential collar-like tilting web, can be integrally formed on this securing portion, which tilting web preferably extends approximately in the plane whose normal vector coincides with the actuation direction. At the end of the tilting web directed away from the securing portion, a deformable part of the effector element extends in or counter to the actuation direction, and the valve flap extends in the opposite direction, such that, upon actuation of the actuation handle, a moment acting due to the actuation on the effector element is coupled into the valve flap in the direction of its open position.

In such an embodiment, the tilting web acts as a decoupling means which permits a coupled translational and/or rotational mobility of the valve flap with the end of the inherently deformable part of the effector element and thus permits the coupling of a load-relieving moment into the valve flap.

In a related type of application of a moment and/or a force to a valve flap, provision is made that the effector element has a securing portion of said type for attaching to the base and/or to the actuation handle, in particular once again a circumferential securing portion. This securing portion merges into a deformable thrust web, in particular a circumferential thrust web, the pressing-down action causing a thrust force to be coupled to the end of the thrust web opposite the securing portion and offset in relation to the valve flap. On the other hand, the valve flap is integrally formed offset toward the securing portion such that, upon actuation of the actuation handle, the offset thrust force applies a tensile force to an outside of the valve flap, which couples a tilting moment into the valve flap in the relief direction.

The invention further relates to a liquid dispenser for discharging pharmaceutical or cosmetic liquids, with a liquid store and with a discharge head of the type described.

The liquid dispenser is suitable in particular with pharmaceutical or cosmetic liquids. By virtue of the mode of operation described above, such a dispenser is readily suitable for transport, since there is usually no danger of leaking. By virtue of the outlet valve being designed in the manner described above, it is possible to achieve a well metered and calculated discharge, even in the event of slow actuation of the actuation handle.

When used for cosmetic liquids, the liquid store of the dispenser is preferably filled with lotions or gels, lotions with a solids fraction, or soap or shampoo. In the case of lotions with a solids fraction, which is not unusual in facial cosmetics, an outlet valve of the type according to the invention has proven useful, since it closes satisfactorily even when a solids particle is present in the region of the sealing surface.

BRIEF DESCRIPTION OF THE DRAWINGS

Further advantages and aspects of the invention will become clear from the claims and from the following description of a preferred illustrative embodiment of the invention, which is explained below with reference to the figures.

DETAILED DESCRIPTION OF THE ILLUSTRATIVE EMBODIMENTS

Figure 1:
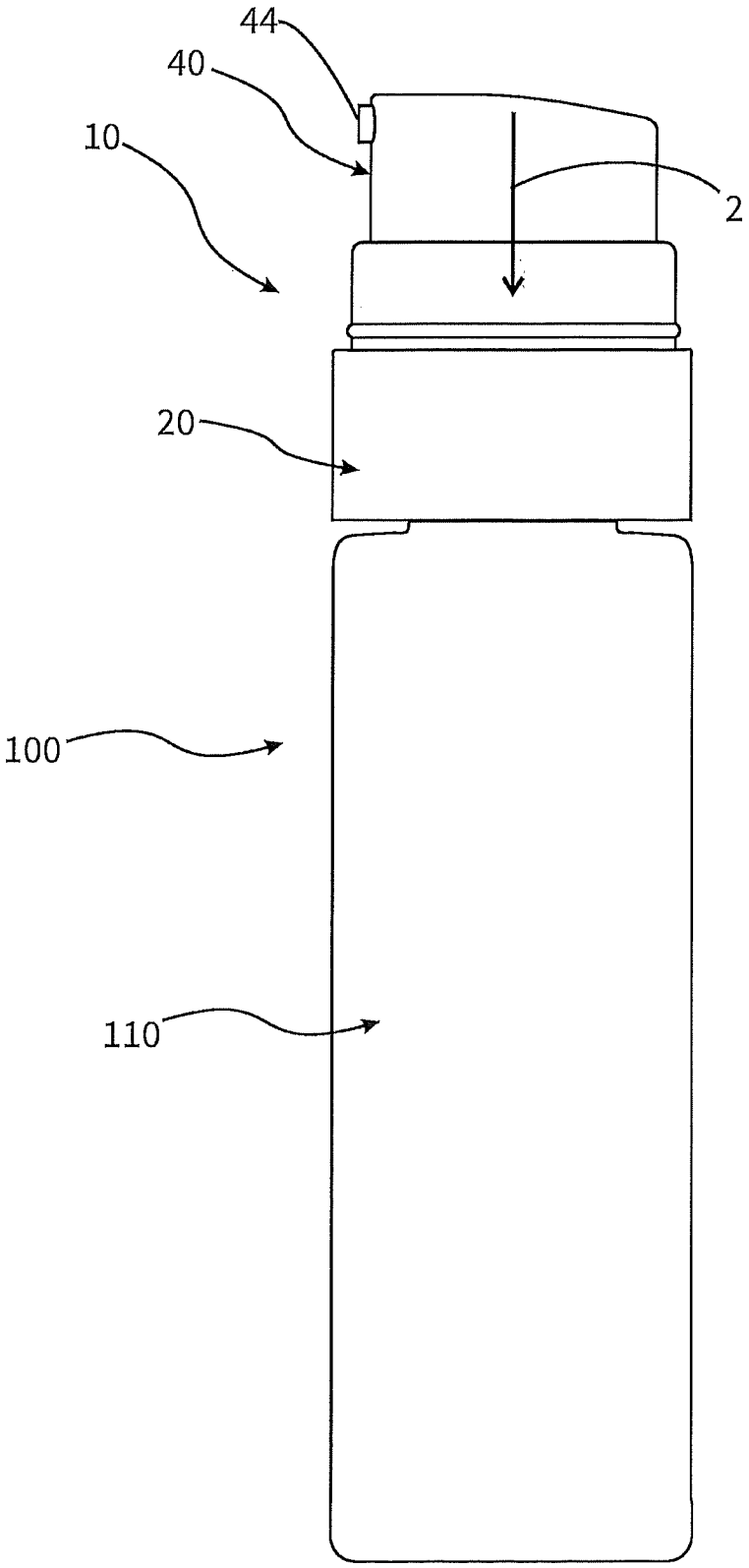
FIG. 1 shows an overall view of a liquid dispenser according to the invention.

FIG. 1 shows a liquid dispenser 100 according to the invention, in the present case a liquid dispenser for discharging cosmetic lotions. The liquid dispenser 100 has a liquid store 110 with a shape like a bottle, at the upper end of which an outlet stub is arranged. The liquid store 110 is screwed into a discharge head 10, which for its part has a base 20 on which an actuation handle 40 designed as a push button is mounted so as to be slidable in an actuation direction 2 for the purpose of discharging liquid through a discharge opening 44.

The discharge head 10 has a pump mechanism 60 (not shown in FIG. 1) with which liquid can be conveyed from the liquid store 110 to a discharge opening 44.

Figure 2:
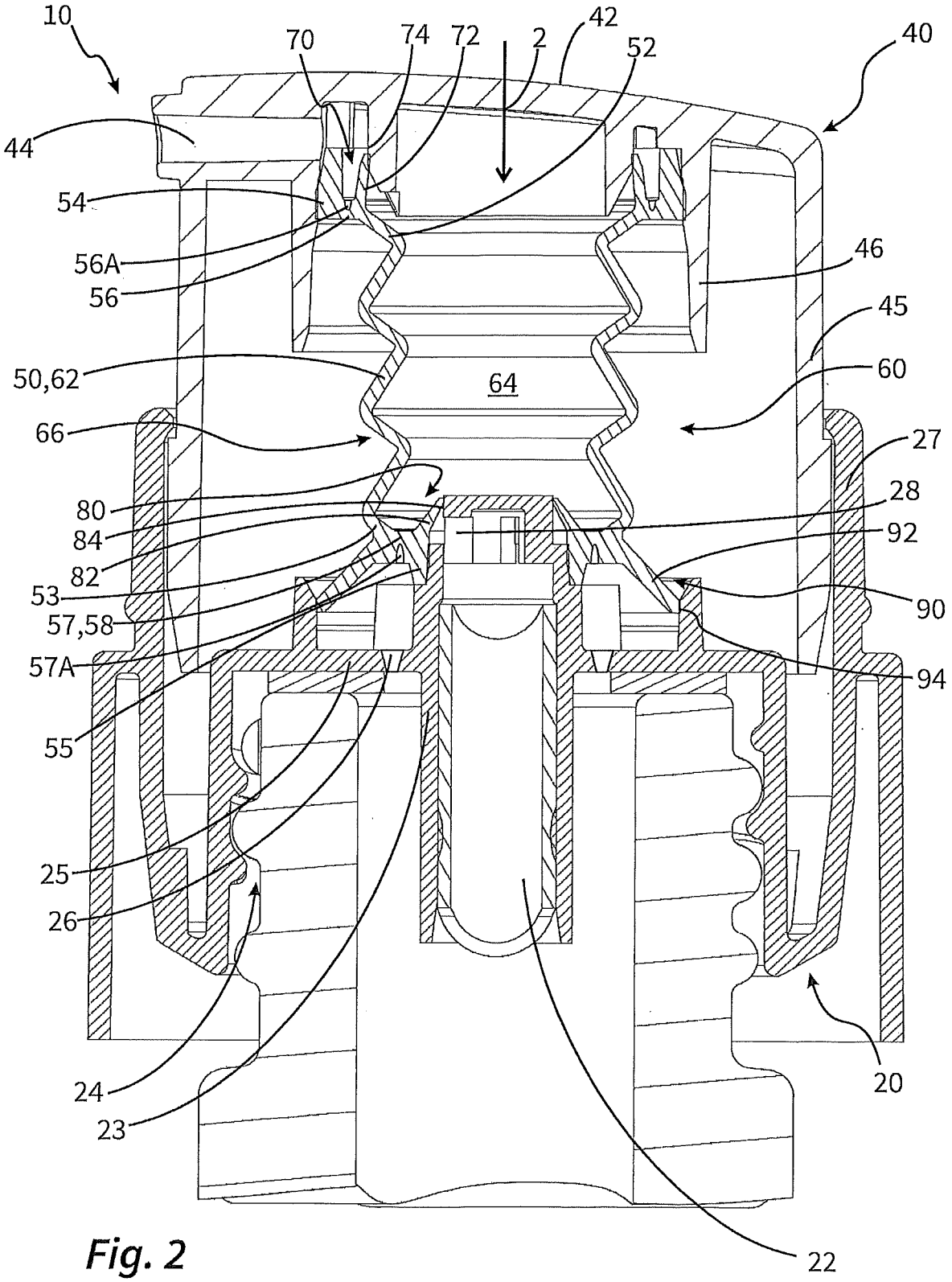
FIG. 2 shows a cross-sectional view of the discharge head of the liquid dispenser from FIG. 1.

FIG. 2 shows the discharge head 10 in an enlarged and cross-sectional view. For the purpose of cost-effective design, the discharge head is constructed from only a small number of components, basically from just a component forming the base 20, a component forming the actuation handle 40, and a pump chamber component 66 which at the same time outwardly delimits a pump chamber 64 and forms valve flaps 72, 82, 92 of three valves 70, 80, 90, namely an inlet valve 80 between the liquid store 110 and the pump chamber 64, an outlet valve 70 between the pump chamber 64 and an environment, and a ventilation valve 90 between the environment and the liquid store 110. In addition to such a discharge head composed of only three parts, the liquid dispenser 100 can also have a dip tube, a seal in the form of a sealing ring between discharge head 10 and liquid store 110, and also a cap (not shown in the figures). The whole dispenser can therefore be constructed from only 4 to 7 parts, which greatly simplifies manufacture and assembly.

The base 20 of the discharge head shown in FIG. 2 has a coupling mechanism 24 in the form of an inner thread, a front face 25 provided with ventilation apertures 26, and an outer sleeve 27 in which the actuation handle 40 is guided displaceably to a limited extent. The front face 25 is interrupted by a liquid inlet 22 with an inlet sleeve 23, which at its end has an opening 28 for the passage of liquid into the pump chamber 64 and on which the pump chamber component 66 is clamped. The inlet valve 80 and its circumferential valve flap 82 are provided between this opening 28 and the pump chamber 64, wherein an annular surface at the end of the inlet sleeve 23 forms a valve surface 84 of the inlet valve. Moreover, an annular structure is provided at the base, the inner face of which annular structure forms a valve surface 94 of the ventilation valve 90.

The actuation handle 40 of the discharge head shown in FIG. 2 is guided displaceably on the base 20 by means of a jacket 45. The discharge opening 44 is arranged at the upper end of the jacket 45. A front end of the actuation handle 40 forms the actuation surface 42. An annular retaining structure 46 for clamping the pump chamber component 66 is provided on the inner face of the actuation handle 40. A further annular web is provided inside the retaining structure 46, the outer face of which annular web forms a valve surface 74 of the outlet valve 70.

When the pressure is the same on both sides, the valve flaps 72, 82 bear with inward pretensioning on the respective valve surface 74, 84. When the pressure is the same on both sides, a third valve flap 92 of the ventilation valve 90 bears with outward pretensioning on the valve surface 94. All three valve flaps 72, 82, 92 are designed circumferentially and therefore have the shape of a portion of a cone or a cylindrical shape.

At the upper end of the pump chamber component 66, a circumferential securing portion 54 is provided, by means of which the pump chamber component 66 is clamped into the retaining structure 46, thereby creating a leaktight coupling of the pump chamber to the discharge opening 44. A thin tilting web 56 extends radially inward from the securing portion 54, wherein a notch 56A is provided in the present illustrative embodiment, such that the tilting web performs the decoupling action that is explained in detail below. To the inside of the tilting web 56, the latter is adjoined by the valve flap 72 counter to the actuation direction 2, while the bellows-like pump chamber wall 62 extends in the opposite direction toward the base 20.

The lower end of the pump chamber component 66 forms a circumferential securing portion 55, which is clamped onto the inlet sleeve 23. The valve flap 82 is formed integrally on this securing portion 55. Facing toward the outside, a tilting or thrust web 57, 58 adjoins the securing portion 55, which in turn is made comparatively thin by means of a circumferential notch 57A. The outer side of the tilting and thrust web 57, 58 is adjoined, in the direction of the actuation handle 40, by the lower end of the bellows-like pump chamber wall 62. In the opposite direction, the tilting and thrust web 57, 58 is adjoined by the valve flap 92 of the ventilation valve 90.

The design of the pump chamber component 66 with said elements and in particular with the valve flaps 72, 82, 92 serves the purpose of influencing the force with which the ends of the valve flaps 72, 82, 92 are pressed against the valve surfaces 74, 84, 94 on account of their being attached to other parts of the pump chamber component 66. The pump chamber component 66 and in particular the bellows-like pump chamber wall 62 thereof form an effector element 50 for controlling this respective force.

Figure 3C:
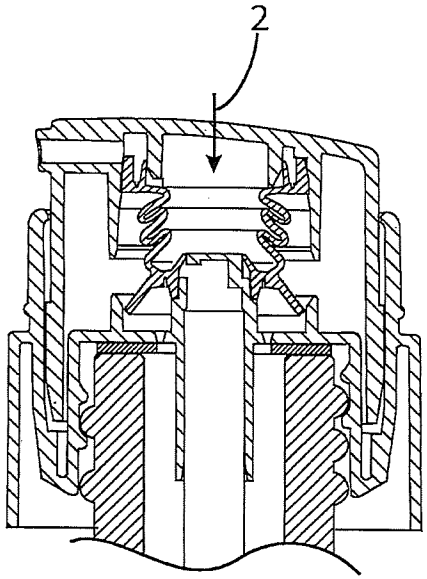
FIGS. 3A to 3C show the discharge head according to FIG. 2 in a non-actuated end position, in a middle position, and in an actuated end position.
Figure 3B:
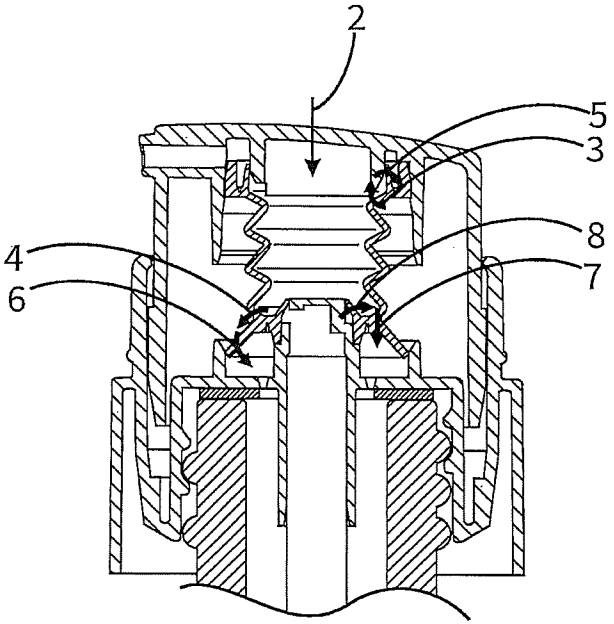
Figure 3A:
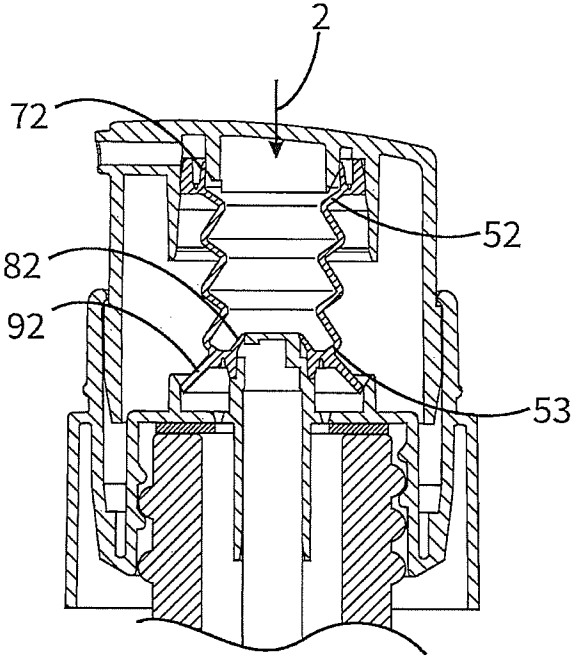

In the upper end position of the actuation handle 40, as shown in FIGS. 2 and 3A, all of the valve flaps 72, 82, 92 are pressed with the respective maximum force against the valve surfaces 74, 84, 94.

If an actuation is now performed by pressing the actuation handle 40 down, the pump chamber component 66 is compressed, wherein the change of length is largely effected completely by the pump chamber wall 62, forming the effector element 50, and by the subportions of the pump chamber wall 62 being laid on one another in the manner of a bellows. Two subportions 52, 53 at the ends of the effector element 50 formed by the pump chamber wall 62 are thus swiveled further in the direction of the arrows 3, 4 from a position in which they were already at an angle relative to the actuation direction 2. On account of the decoupling in relation to the respective securing portions 54, 55 by means of the tilting webs 56, 57, this swiveling has the effect that an equidirectional moment is coupled in the direction of the arrows 5, 6 into the valve flaps 72, 92, which moment, although not sufficient to release the valve flaps 72, 92 from the valve surfaces 74, 94, nonetheless reduces the pressing force that is acting there.

The tilting and thrust web 58 moreover has the effect that the subportion 53 and the valve flap 92 are shifted slightly in the direction of the arrow 7 in relation to the securing portion 54. This gives rise to a tensile force in that side of the valve flaps 82 of the inlet valve 80 facing toward the pump chamber 64, as a result of which a moment is also coupled in there, which moment acts in the direction of the arrow 8 and also reduces the pressing force on the valve surface 84 at this valve flap 82.

The state obtained in FIG. 3B constitutes an intermediate setting of the actuation handle 40. The pressing force of the valve flaps 72, 82, 94 on the valve surfaces 74, 84, 94 is in each case reduced in this state and has the effect that, at each of the valves, the threshold positive pressure needed to open the valve is reduced. In the present embodiment, the threshold positive pressure at the outlet valve 70 is already reduced by approximately 30%. At the inlet valve 80, the threshold positive pressure is reduced by approximately 20%. At the ventilation valve 90, the threshold positive pressure is reduced by approximately 50%.

Upon continued movement in the direction of the actuated end position, which is shown in FIG. 3C, the deformations are in each case intensified, such that the pressing force of the valve flaps 72, 82, 92 on the valve surfaces 74, 84, 94 drops further. When the actuated end position according to FIG. 3C is reached, the threshold positive pressure at the outlet valve 70 and at the inlet valve 80 is reduced to approximately 50% and approximately 30%, respectively, of the original threshold positive pressure in the non-actuated end position. At the ventilation valve 90, the threshold positive pressure has dropped to 0 bar, such that the valve flap 92 has withdrawn from the valve surface 94 and the ventilation valve 90 is thus open.

When the actuation handle 40 is let go, the pump chamber wall 62 brings about a restoring force, by which the actuation handle 40 is pressed via the state in FIG. 3B back to the state in FIG. 3A.

The description of the sequence involved in pressing down the actuation handle 40 on the basis of FIGS. 3A to 3C has thus far been explained without reference to the liquid to be discharged or to the compensating air flowing into the liquid store 110.

In normal operation, with a filled liquid store attached, the procedure is as follows: Starting from the state in FIG. 3A, the actuation handle is actuated counter to a resistance that is at a maximum at the start, since the valve flap 72 of the outlet valve 70 is in this state pressed with maximum force onto the valve surface 74. When the initial resistance thus provided has been overcome, the valve flap 72 is opened, as movement starts, by the positive pressure in the pump chamber 64, and, as the pump chamber wall 62 and therefore the effector element 50 begin to deform, the pressure needed to keep the outlet valve 70 open is reduced. Even if the actuation slows down, the outlet valve 70 thus remains open. It is only at a standstill that it closes, notwithstanding the partial stroke that has occurred to that point. Meanwhile, on account of the configuration of the pump chamber component 66, the inlet valve 80 and the ventilation valve 90 are already closed, wherein the inlet valve 80 is additionally pressed into the closed position by the pressure in the pump chamber 64.

When the actuated end position of FIG. 3C is reached, the outlet valve closes despite the reduced threshold positive pressure, since the positive pressure in the pump chamber 64 relative to the environment drops to 0 bar. The ventilation valve 90 has already opened, while the valve flap 82 of the inlet valve 80 still bears on the valve surface 84 and is pressed against the latter, such that the inlet valve is still closed.

When the return stroke of the actuation handle 40 begins, the inlet valve 80 opens immediately, since the restoring force is at a maximum at this time, and since the threshold positive pressure for opening the inlet valve is at a minimum. The pump chamber 64 thus directly begins to refill. The already open ventilation valve 90 permits unimpeded inward flow of compensating air through the ventilation apertures 26 into the liquid store, and it remains reliably open during most of the return stroke. The result of this is a very rapid restoration of the actuation handle 40, with complete refilling of the pump chamber 64. After the non-actuated end position of FIG. 3A has been reached again, the next actuating stroke can begin immediately.

The invention claimed is:

1. A discharge head for a liquid dispenser for discharging pharmaceutical or cosmetic liquids, said discharge head comprising:

a base;

an actuation handle, said actuation handle being configured for pressing downward in an actuation direction and movable relative to said base between a non-actuated end position and an actuated end position;

a liquid inlet for connection to a liquid store;

a discharge opening for dispensing liquid to an environment;

a pump mechanism including a pump chamber for conveying liquid from the liquid store to said discharge opening, said pump chamber being arranged between said actuation handle and said base;

a valve configured to open based on pressure, said valve being arranged in one of the following locations: between said pump chamber and said discharge opening; between said liquid inlet and said pump chamber; or in a ventilation channel connecting the environment to the liquid store, said valve having a valve flap which closes a valve channel in a closed position and is transferable to an open position, said valve flap being transferable to said open position by a positive pressure exceeding a threshold positive pressure, the threshold positive pressure being present in one of the following: said pump chamber when said valve is arranged between said pump chamber and said discharge opening; the liquid store when said valve is arranged between said liquid inlet and said pump chamber; or the environment when said valve is arranged in said ventilation channel; and a deformable effector element disposed to bear on said actuation handle and said base, said deformable effector element deforming when said actuation handle is pressed downwardly in the actuation direction, said valve flap being attached to said deformable effector element at an attachment area, said valve flap and said attachment area being configured and disposed such that deformation of said deformable effector element acts on said valve flap to lower the threshold positive pressure by at least 10% in the actuated end position of said actuation handle as compared to the non-actuated end position of said actuation handle.

2. The discharge head according to claim 1, wherein said valve comprises one or more of the following: an outlet valve disposed between said pump chamber and said discharge opening, said outlet valve opening due to liquid pressure in said pump chamber as a size of said pump chamber decreases; an inlet valve disposed between said liquid inlet and said pump chamber, said inlet valve opening due to negative pressure in said pump chamber as a size of said pump chamber increases; and a ventilation valve disposed in said ventilation channel, said ventilation valve opening due to negative pressure in the liquid store.

3. The discharge head according to claim 1, wherein said valve has a valve seat and a valve channel defined between said valve flap and said valve seat, said valve flap being positioned relative to said valve seat to prevent flow of liquid through said valve in said closed position thereof, and said valve flap is positioned relative to said valve seat to permit flow of liquid through said valve in said open position thereof, and deformation of said deformable effector element adjacent said attachment area controls a force with which said valve flap presses against said valve seat to cause the threshold positive pressure to be at least 10% lower in the actuated end position of said actuation handle as compared to the threshold positive pressure in the non-actuated end position of said actuation handle.

4. The discharge head according to claim 1, wherein said valve flap is configured and disposed to move in an opening direction in order to achieve said open position of said valve, and said valve flap and said attachment area are configured and disposed such that deformation of said deformable effector element induces a force into said valve flap, the force being oriented in the opening direction of said valve flap to decrease the threshold positive pressure.

5. The discharge head according to claim 1, wherein said valve flap and said attachment area are configured and disposed such that deformation of said deformable effector element acts on said valve flap such that the threshold positive pressure is one of: at least 30% lower in the actuated end position of said actuation handle as compared to the threshold positive pressure in the non-actuated end position; or 30% lower in the actuated end position of said actuation handle as compared to the threshold positive pressure in the non-actuated end position.

6. The discharge head according to claim 1, wherein said actuation handle is movable relative to said base into a middle position located between the non-actuated end position and the actuated end position, and said valve flap and said attachment area are configured and disposed such that deformation of said deformable effector element acts on said valve flap such that the threshold positive pressure is one of: at least 5% lower in the middle position of said actuation handle as compared to the threshold positive pressure in the non-actuated end position; at least 15% lower in said middle position of said actuation handle as compared to the threshold positive pressure in the non-actuated end position; or at least 20% lower in the middle position of said actuation handle as compared to the threshold positive pressure in the non-actuated end position.

7. The discharge head according to claim 1, wherein said valve flap and said attachment area are configured and disposed such that the threshold positive pressure does not fall to a value of 0 bar or below 0 bar, even in the actuated end position.

8. The discharge head according to claim 1, wherein said valve flap and said deformable effector element comprise a one-piece integral component.

9. The discharge head according to claim 1, wherein said pump mechanism comprises a pump chamber wall disposed in surrounding relation with, and defining, said pump chamber, said pump chamber wall comprising a hose component having an open inlet end secured to said base and an open outlet end secured to said actuation handle, said pump chamber wall, or a part of said pump chamber wall, defining said deformable effector element.

10. The discharge head according to claim 1, wherein said deformable effector element has a shape, said shape being curved or bent a plurality of times in opposite directions, said shape shortening in a manner of a concertina upon movement of said actuation handle in the actuation direction.

11. The discharge head according to claim 1, wherein said pump mechanism comprises a pump chamber wall defining said pump chamber and said deformable effector element is formed by said pump chamber wall or a part of said pump chamber wall, said pump chamber wall being configured as a bellows having a shape, said shape being curved or bent a plurality of times in opposite directions such that said pump chamber wall shortens upon movement of said actuation handle in the actuation direction.

12. The discharge head according to claim 1, wherein said deformable effector element has a subportion oriented at a first angle relative to the actuation direction in the non-actuated end position, and said subportion being arranged on said deformable effector element such that upon movement of said actuation handle in the actuation direction said deformable effector element deforms and said subportion is swiveled or pivoted and is oriented at a second angle relative to the actuation direction, said second angle being greater than said first angle, said valve flap being disposed on said subportion and being configured and disposed to move in an opening direction in order to achieve said open position of said valve, said subportion inducing a moment of force on said valve flap in the opening direction during movement of said actuation handle in the actuation direction.

13. The discharge head according to claim 1, wherein said valve flap is configured and disposed to move in an opening direction in order to achieve said open position of said valve, said deformable effector element comprises a securing portion attached to one of said actuation handle or said base and a deformable tilting web with a first end attached to said securing portion and a second end spaced from said first end, said deformable tilting web forming at least part of said attachment area and extending transversely to the actuation direction, said deformable effector element further comprising a deformable part extending substantially along or counter to the actuation direction, said valve flap extending from said second end of said deformable tilting web in an opposite direction from said deformable part such that a moment of force acting on said deformable part is coupled into said valve flap in the opening direction upon movement of said actuation handle in the actuation direction.

14. The discharge head according to claim 13, wherein said securing portion and said deformable tilting web each extend circumferentially around said deformable effector element, and said deformable effector element has a notch formed therein adjacent said valve flap, said notch forming at least part of said attachment area.

15. The discharge head according to claim 1, wherein said deformable effector element comprises a securing portion attached to said base and a deformable thrust web with a first end attached to said securing portion and a second end spaced from said first end, said deformable thrust web forming at least part of said attachment area, said valve flap being integrally formed on said first end of said deformable tilting web such that upon movement of said actuation handle in the actuation direction a thrust force is coupled into said second end of said deformable thrust web offset from said valve flap, the thrust force applying a tensile force to an outside of said valve flap to cause a tilting moment in said valve flap.

16. The discharge head according to claim 15, wherein said securing portion and said deformable thrust web each extend circumferentially around said deformable effector element, and said deformable effector element has a notch formed therein adjacent said valve flap.

17. The discharge head according to claim 1, wherein said base and said actuation handle together define an interior of said discharge head, said pump mechanism including a one-piece pump chamber component defining said pump chamber therein, said one-piece pump chamber component being disposed in said interior of said discharge head.

18. A discharge head for a liquid dispenser for discharging pharmaceutical or cosmetic liquids, said discharge head comprising:

a base;

an actuation handle mounted on said base for movement relative to said base in an actuation direction between a non-actuated end position and an actuated end position;

a liquid inlet disposed for fluid communication with a liquid store;

a discharge opening in communication with said liquid inlet and disposed to discharge liquid to an environment exterior to said discharge head;

a pump mechanism including a pump chamber, said pump chamber being disposed between said actuation handle and said base, said pump chamber being configured for conveying liquid from the liquid store to said discharge opening;

a valve configured to open based on pressure and being arranged in one of the following locations: between said pump chamber and said discharge opening; between said liquid inlet and said pump chamber; or in a ventilation channel provided on said discharge head and configured for connecting the liquid store to the environment, said valve having a valve flap, a valve seat and a valve channel disposed between said valve flap and said valve seat, said valve having a closed position in which said valve flap is positioned relative to said valve seat to prevent flow of liquid through said valve and an open position in which said valve flap is positioned relative to said valve seat to permit flow of liquid through said valve, said valve flap being transferable to said open position by a positive pressure exceeding a threshold positive pressure present in one of the following: said pump chamber when said valve is arranged between said pump chamber and said discharge opening; the liquid store when said valve is arranged between said liquid inlet and said pump chamber; or the environment when said valve is arranged in said ventilation channel; and an effector element disposed to bear on said actuation handle and said base and being deformed when said actuation handle is moved relative to said base, said valve flap being attached to said effector element at an attachment area, and deformation of said effector element adjacent said attachment area controls a force with which said valve flap presses against said valve seat to cause the threshold positive pressure to be at least 10% lower in the actuated end position of said actuation handle as compared to the threshold positive pressure in the non-actuated end position of said actuation handle.

19. The discharge head according to claim 18, wherein said effector element includes a first securing end portion connected to said base and a second securing end portion spaced from said first securing end portion and connected to said actuation handle, said effector element further including at least one deformable wall portion disposed adjacent and connected to said first securing end portion or said second securing end portion, said attachment area comprising a deformable web portion connected to said valve flap and said one first securing end portion or said one second securing end portion, and deformation of said at least one deformable wall portion adjacent said deformable web portion lessens the force with which said valve flap presses against said valve seat.

20. A liquid dispenser for discharging pharmaceutical or cosmetic liquids, said liquid dispenser comprising:

a liquid store;

a discharge head, said discharge head comprising:

a base connected to said liquid store;

an actuation handle, said actuation handle being configured for pressing downward in an actuation direction and movable relative to said base between a non-actuated end position and an actuated end position;

a liquid inlet connected to said liquid store;

a discharge opening for dispensing liquid to an environment;

a pump mechanism including a pump chamber for conveying liquid from said liquid store to said discharge opening, said pump chamber being arranged between said actuation handle and said base;

a valve configured to open based on pressure, said valve being arranged in one of the following locations: between said pump chamber and said discharge opening; between said liquid inlet and said pump chamber; or in a ventilation channel connecting the environment to said liquid store, said valve having a valve flap which closes a valve channel in a closed position and is transferable to an open position, said valve flap being transferable to said open position by a positive pressure exceeding a threshold positive pressure, the threshold positive pressure being present in one of the following: said pump chamber when said valve is arranged between said pump chamber and said discharge opening; said liquid store when said valve is arranged between said liquid inlet and said pump chamber; or the environment relative to said liquid store when said valve is arranged in said ventilation channel; and a deformable effector element disposed to bear on said actuation handle and said base, said deformable effector element deforming when said actuation handle is pressed downwardly in the actuation direction, said valve flap being attached to said deformable effector element at an attachment area, said valve flap and said attachment area being configured and disposed such that deformation of said deformable effector element acts on said valve flap to lower the threshold positive pressure by at least 10% in the actuated end position of said actuation handle as compared to the non-actuated end position of said actuation handle.

* * * * *